US005268083A

United States Patent [19]

Rathgeber et al.

[11] Patent Number: 5,268,083

[45] Date of Patent: Dec. 7, 1993

[54] APPARATUS FOR ALIGNING ANODE STUBS

[75] Inventors: Roland Rathgeber, Neuss; Erwin Collet, Lunen, both of Fed. Rep. of Germany

[73] Assignees: Westfalia Becorit Industrietechnik GmbH, Lunen; VAW Aluminium AG, Bonn, both of Fed. Rep. of Germany

[21] Appl. No.: 917,204

[22] Filed: Jul. 20, 1992

[30] Foreign Application Priority Data

Jul. 20, 1991 [DE] Fed. Rep. of Germany ..... 4124211

[51] Int. Cl.[5] ..... C25C 3/10

[52] U.S. Cl. ..... 204/243 R; 204/279; 204/245

[58] Field of Search ..... 204/243 R, 244–247, 204/67, 279

[56] References Cited

U.S. PATENT DOCUMENTS

| | | | |
|---|---|---|---|
| 4,119,505 | 10/1978 | Baillot et al. | 204/245 X |
| 4,510,033 | 4/1985 | Martin et al. | 204/245 |
| 4,701,249 | 10/1987 | Wisniewski et al. | 204/245 X |
| 4,855,031 | 8/1989 | Zannini | 204/225 |
| 5,096,631 | 3/1992 | Syversen | 204/279 X |

*Primary Examiner*—Donald R. Valentine
*Attorney, Agent, or Firm*—Darby & Darby

[57] ABSTRACT

The present invention relates to an apparatus for aligning the stubs disposed on the yoke of an anode rod used in an aluminum electrolytic extraction cell, the anode rod having a yoke portion to which are secured two outer and an inner stub and a rod portion, the apparatus comprising a platform, first and second receiving elements for grasping the two outer stubs, which are slideably mounted on the platform, and equipment attached to the platform for driving the first receiver element in a direction directly opposite the movement of the second receiver element.

22 Claims, 3 Drawing Sheets

APPARATUS FOR ALIGNING ANODE STUBS

FIELD OF THE INVENTION

The invention relates to equipment for increasing the service life of aluminum production cells without additional replacement of parts and more specifically to an apparatus for aligning the stubs which extend from the anode yokes of anode rods used in aluminum production cells.

BACKGROUND OF THE INVENTION

In reduction cells used for the production of aluminum, the carbon-based anode blocks are consumed relatively more rapidly than the cathode blocks. Accordingly, the anode region of such cells requires relatively more frequent servicing. Current is carried to the anode blocks via anode rods, each generally having a yoke which has protrusions. These protrusions are called anode stubs or anode nipples. The anode blocks are contacted via these stubs. For proper contacting to occur, the stubs must fit into receiver boreholes in the anode blocks.

In the more common arrangements, the anode rods have three adjacent and parallel stubs (two "outer" stubs and an "inner" stub) disposed in one plane or two sets of three anode stubs in parallel arrangement. When aligned, all of the stubs are parallel to the anode rod. The anode rods are often constructed of aluminum, while the stubs are often constructed of steel or cast steel.

When the anode blocks are replaced, the anode rods must be serviced by stripping off caked material from the alumina/aluminum bath. More importantly, due to the large temperature gradients which occur during the operation of the cell, the stubs are often deformed during the course of operation of the cell. These deformed stubs must be repaired so that the anode rod can be coupled to the replacement anode block. Usually, when the outer stubs are deformed, they are bent towards the inner stub (or in some arrangements, towards the inner stubs). The customary repair process has been to sever the deformed stubs and to weld new, correctly aligned stubs in their place.

German patent 35 41 504 discloses equipment for checking anode rods for breakage or for alignment problems. However, this equipment cannot be used to correct any bent stubs which it may detect.

OBJECT OF THE INVENTION

It is the object of this invention to provide an apparatus for reliably and facilely re-aligning anode stubs instead of severing and replacing them.

SUMMARY OF THE INVENTION

In an illustrative embodiment, the aligning apparatus of the invention has receiving elements for grasping the outer stubs and equipment for driving the receiver elements (and the grasped outer stubs) in a direction at right angles to the anode rod (or to the inner stub). For simplicity, the above recited elements of the apparatus are referred to below as the "aligning elements." The apparatus also restrains at least one inner anode stub from movement along an axis perpendicular to the anode rod and has an overall frame.

Using the invention, it is possible to align deformed anode rod stubs in one operating cycle. Once engaged by the aligning elements, the outer stubs can be bent into the correct alignment parallel to the anode rod (or the inner stub).

In a preferred embodiment of the invention, the anode rods are carried to and from the apparatus via an overhead conveyor mechanism. Accordingly, the other preferred features of the apparatus will be described assuming the orientation wherein the anode stubs are suspended from above. The axis along which the rod is oriented when introduced into the apparatus is thus the vertical axis. More generally, the rod will be oriented along axis z, which may be any axis.

The aligning elements and, if present, the inner stub restraining elements are advantageously disposed in a horizontal guide platform. The apparatus also may have a mechanism of disposing the horizontal guide platform upwards or downwards. With the horizontal guide platform in a lower position, the anode rod can be introduced into the apparatus such that the anode horizontal rod stubs are disposed above the horizontal guide platform. The location (in the horizontal plane) of the inner stub restraining elements and the outer stub receiving elements can then be adjusted to match the location of the corresponding stubs. The location of the receiving elements can be slidably adjusted despite their connection to the receiver elements driving mechanism, i.e., the driving mechanism compresses to accommodate the movement of the receiving elements. The horizontal guide platform can then be elevated so that the inner stub restraining and outer stub receiving elements engage the corresponding stubs.

The equipment for driving the receiver elements advantageously comprises a hydraulic cylinder, preferably two cylinders. These cylinders may be double-acting cylinders. Double-acting cylinders are those hydraulic cylinders that are capable of both hydraulic expansion and hydraulic compression, allowing exact control of movement in both directions.

The aligning apparatus advantageously has anode yoke supporting elements, which support the yoke against upwards and lateral motion while the anode stubs are engaged by the restraining and receiving elements. These supporting elements may be adapted to the shape of the anode rods which are to be realigned. For this purpose, the supporting elements may comprise replaceable fittings. Each set of these replaceable fittings is adapted to the shape of a particular anode yoke.

An upper portion of the overall apparatus frame has elements for securing and centering the suspended anode rod. Advantageously, the anode rod securing elements comprise a clamping mechanism. The anode rod securing elements secure the rod against lateral motion but allow vertical movement by the rod. When secured, the anode rod is in the "centering position".

Generally, the anode rod is brought into the apparatus at a height such that the yoke passes underneath the anode rod supporting elements. Once the rod has been centered and the stubs engaged by the aligning elements and the inner stub restraining elements, the anode rod and the horizontal guide platform can be elevated until the yoke comes to rest against the supporting elements. This arrangement of the parts of the apparatus is called the "aligning position." The apparatus may have elements which secure the horizontal guide platform at the aligning position.

The horizontal guide platform securing elements are preferably pivotable latches, which may be actuated by hydraulic cylinder driving mechanisms. After the anode stubs of an anode rod have been aligned, the latches are opened, the aligning frame is lowered, and the anode rod securing mechanism is released. At this point, the aligned rod may be removed (e.g., via the overhead conveyor mechanism) and another rod can be introduced into the apparatus.

The inner stub restraining elements may comprise an inner stub restraining housing having a closed bottom. When the horizontal guide platform is elevated to engage the stubs, the inner stub enters the opening and the stub is restrained from moving laterally by the walls of the opening. The bottom of the housing opening can support the inner stub and its attached anode yoke and rod. The lateral walls of the opening may comprise clamps which can engage the inner stub so that it is restrained from movement in any direction.

The clamping mechanism may comprise a hydraulic driving cylinder mounted on the underside of the horizontal guide platform and hingeably coupled by a lever mechanism to two clamping jaws disposed on either opposite side of the inner stub (when the anode rod is in the aligning position). The lever mechanism is effective to convey the force from the driving cylinder to close the jaws and grasp the stub.

The outer stub receivers may comprise stub receiver openings in a stub receiver housing. Advantageously, the opening comprises an opening in the ball of a ball-and-socket joint situated in the receiver housing. In this way, the receiver opening is capable of adjusting to the angle of the outer stubs, which may be substantially deformed from the desired orientation parallel to the anode rod.

The horizontal guide platform may include stop elements for limiting the movement of the receiver housings in the horizontal plane and thus the degree to which the receiver elements driving equipment can bend the stubs during the alignment process. Simple adjustable screw stops may be mounted on the horizontal guide platform to serve this purpose.

The horizontal guide platform is advantageously mounted on vertical guide mounts or columns. These guide mounts assure that when the platform is lifted or lowered, the aligning elements will remain appropriately disposed in the horizontal plane. The guide columns may be telescoping columns. The mechanism for disposing the platform upwards or downwards may comprise at least one hydraulic lifting cylinder.

In a preferred embodiment, the outer stub receiver means are mounted on aligning plates slidably mounted in the horizontal guiding platform. It is these plates which are engaged by the receiver elements driving equipment and which convey the driving force to the receiving elements The aligning plates may be mounted on the guiding platform so that they move (slide) along the axis defined by a line, in a horizontal plane, intersecting an inner and an outer stub.

The upper side of the overall frame may include a conveyor guide formed of two guide rails which are parallel over most of their length. The guide rails may be bent away from one another as the conveyor guide reaches the end of the overall frame. The conveyor guide serves to facilitate and guide the movement of the anode rods into and out of the apparatus. The broader regions of the conveyor guide formed by the bent rails serve to guide the suspended anode rods into the apparatus.

The above discussed anode rod securing elements, also called rod centering elements, are located adjacent to the conveyor guide at a location along the guide appropriate for centering the anode rod and its anode stubs above the aligning elements. The clamping mechanism may comprise two flaps which can be actuated by a hydraulic cylinder driving mechanism.

BRIEF DESCRIPTION OF THE DRAWINGS

FIG, 1 shows an upper view of an apparatus according to the invention.

DETAILED DESCRIPTION OF THE INVENTION

Figure 1:
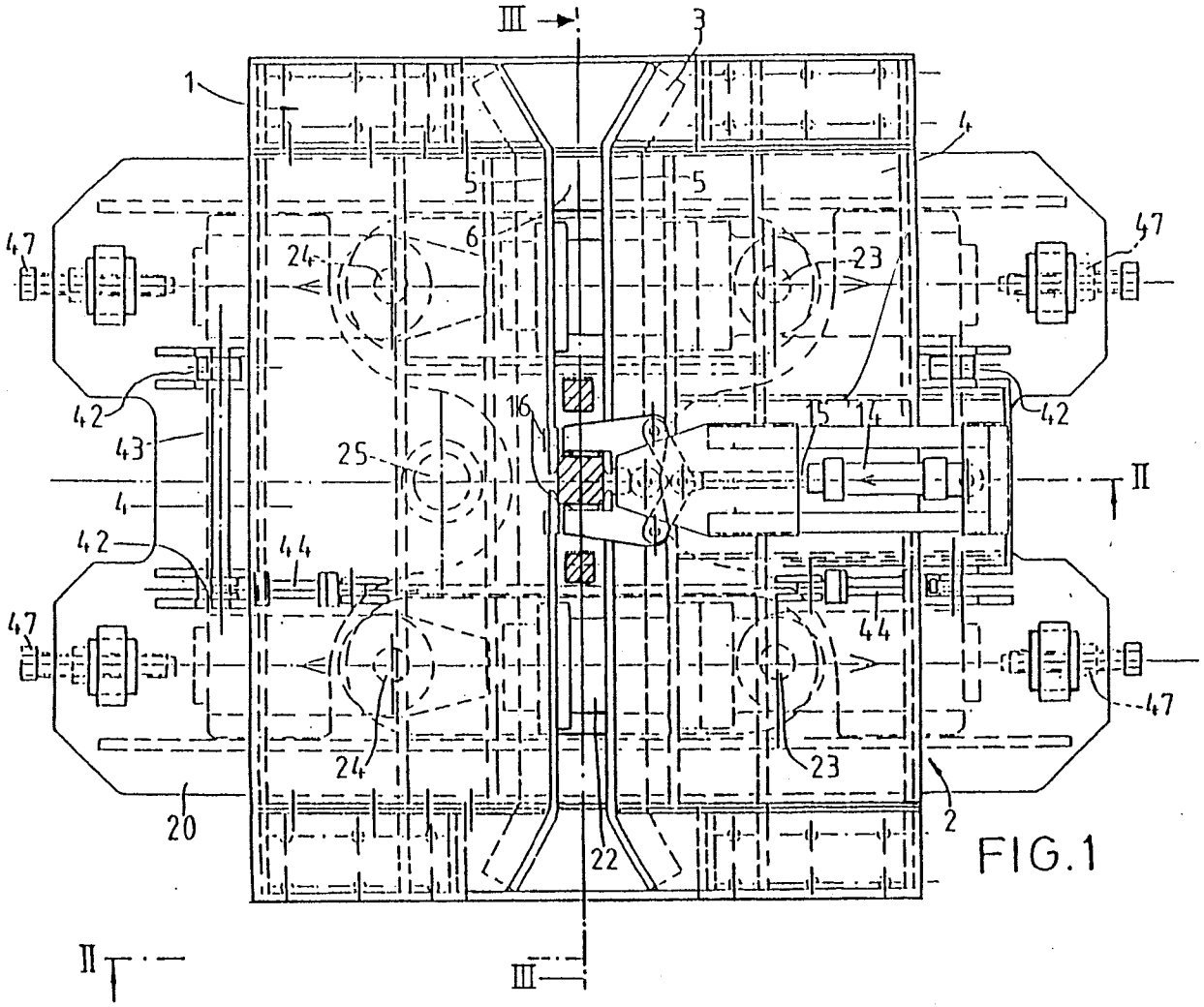

The invention is described below in greater detail with reference to the preferred embodiment which is represented in the drawings.

The overall frame 1 has a adjustably mounted aligning frame 2, which is largely composed of the horizontal guide platform 20. The aligning frame can be lifted or lowered relative to the rest of the overall frame. The overall frame 1 has two guide stands 4, which stand on a common base plate 3. The two guide stands each support two separate guide rails 5. The two guide rails run parallel on the upper side of the overall frame, forming a slot like conveyor guide 6 for the anode rods. At the inlet and outlet side of the conveyor guide, the guide rails are bent 45°, forming a 90° conical guide into which the anode rods may be guideably introduced.

Figure 2:
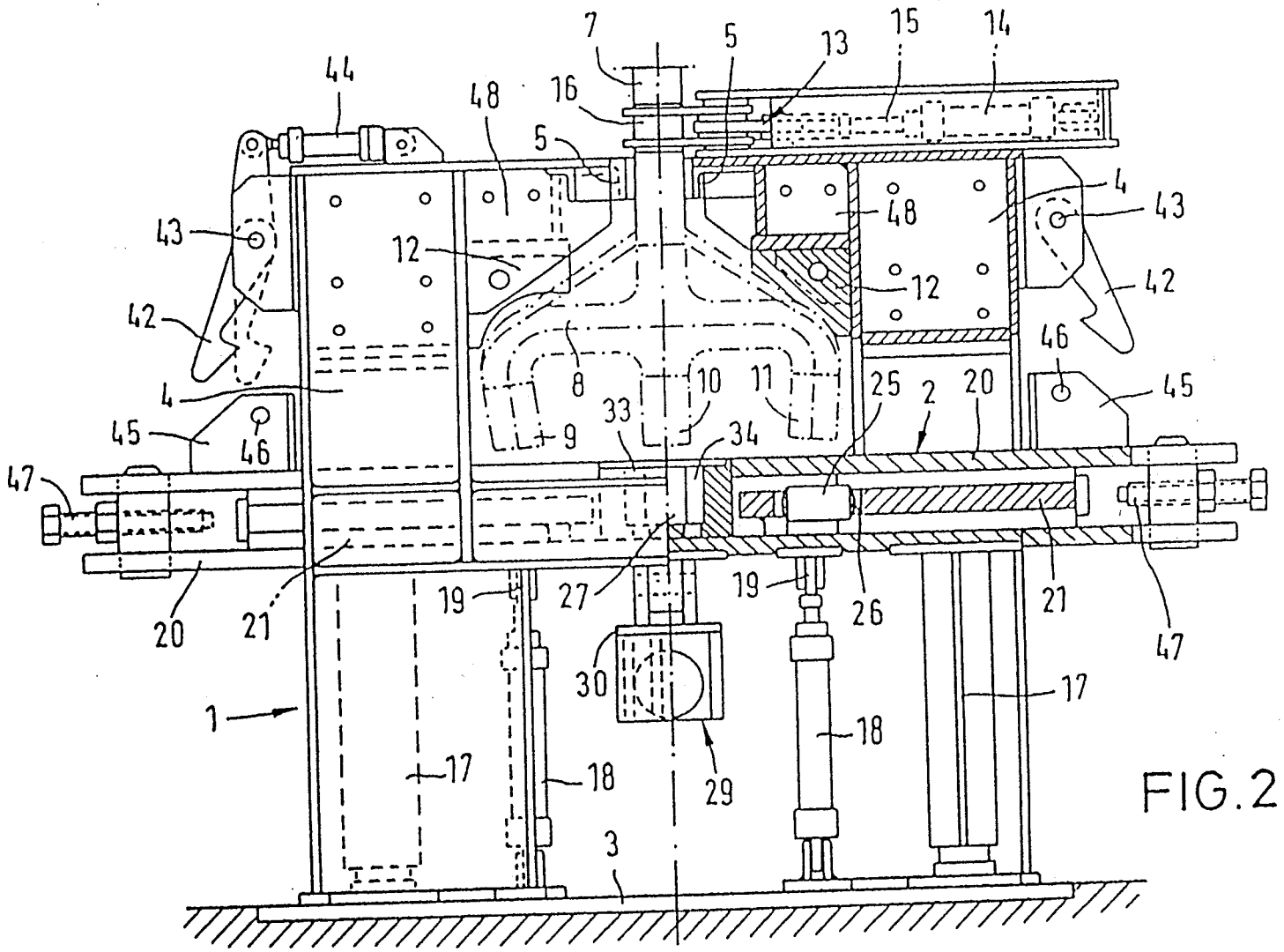
FIG. 2 shows cross-section II indicated in FIG. 1.

In FIG. 2, an inner cross section of the apparatus is shown. The cross-section slices through the axis along which the bending and realigning operations occur. A misaligned anode rod 7 is represented by a dot-dash lines. This cross section represents the placement of the various parts of the apparatus when the anode rod has been secured in the centering position but just prior to the engagement of the anode stubs by the aligning elements. Thus, the aligning elements are disposed below the anode stubs 9, 10, 11 The anode stubs are disposed on the anode rod via a transverse yoke 8. During the aligning process in accordance with the invention, the outer stubs 9 and 11 will be bent back into a position parallel to the undeformed inner stub 10.

If the anode rod has six stubs in two mutually parallel rows of three stubs each, the two sets may be aligned in successive operations of the apparatus.

The overall frame preferably has exchangeable anode rod supporting fittings 12, such that the frame and the fittings form a supporting apparatus for the anode yoke. The supporting fittings help to support and maintain the shape of those portions of the yoke which are not intended to be bent and realigned.

One of the two guide stands has an upper covering plate which supports an anode rod securing and centering apparatus 13 and a hydraulic cylinder driving mechanism 14. The driving mechanism is driveably connected to a piston rod 15 which is driveably connected to two centering flaps that are hingeably attached to two vertical hinge pins which are attached to the upper covering plate. The centering flaps are shown in their closed position in each of the figures. The centering flaps would be open when an anode rod is being transported into the apparatus. When the anode rod reaches the centering position, the centering flaps are closed by the action of the cylinder driving mechanism 14 which swings the flaps inward to fasten and steady the anode rod. This centering mechanism serves to dampen the oscillation in the anode rod and restrict its lateral motion but is generally not intended to ridgedly clamp and support the rod. In fact, generally it is intended that the rod can be slideably elevated or lowered while secured by this mechanism.

The upward or downward motion of the aligning frame 2 is guided by its linkage to a vertical guide 17, best seen in FIG. 2 and which is, in this instance, a telescoping guide. The vertical guide prevents the lateral shifting of the aligning frame within the overall frame. Lifting of the aligning frame is accomplished by hydraulic lifting cylinders 18, which are supported on the base plate 3. These lifting cylinders are connected to the aligning frames by joints 19.

The aligning frame 2 includes a horizontal guiding platform 20. Within the box-like structure of the horizontal guiding platform shown are two aligning plates 21 The guiding platform guides the motion of the aligning plates so that they move only horizontally and along the axis moving directly towards or away from one another. Two hydraulic aligning cylinders 22 are parallelly disposed between the two aligning plates 21 and are disposed within the guiding platform. Each cylinder 22 is connected to the first aligning plate at joint 23 and via its cylinder piston rod to the second aligning plate at joint 24, as seen in FIG. 1. Attached to the aligning plates are the stub receiving housings which are located along a line which is parallel to the axis of the two cylinders and is mid-point between the two cylinders. These stub receiving housings consist of ball-and-sockets 25 having a ring-shaped opening in the ball of suitable size for receiving the stub. The socket mechanism allows the axis of the opening to be adjusted to correspond to the angle of the anode stub to be inserted The spherical surface 26 of the ball or socket contains bearings or bearing mounts to facilitate the ball-and-socket adjustability of the opening.

Figure 3:
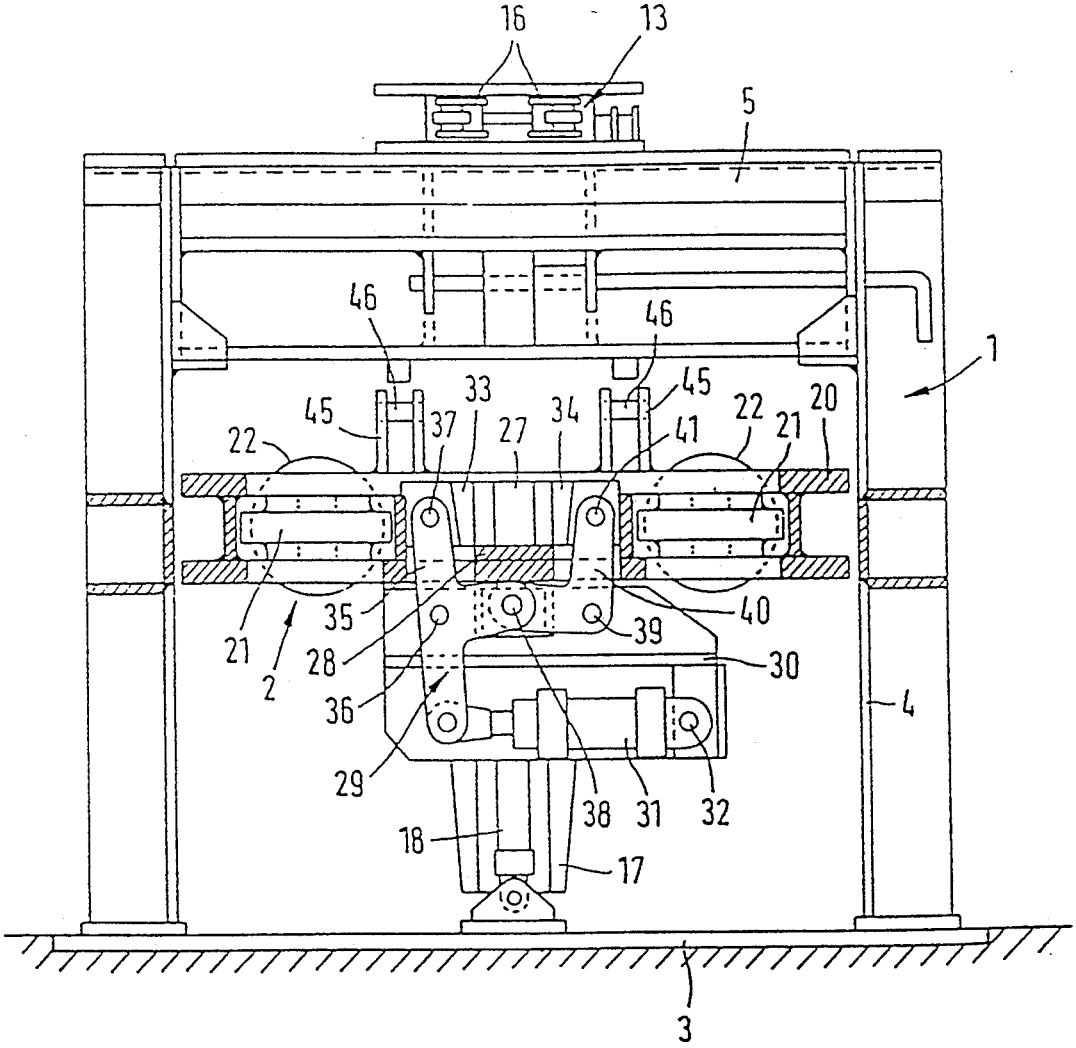
FIG. 3 shows cross-section III indicated in FIG. 1.

Directly between the two aligning plates 21 and along the same axis along which the receiving housings are situated there is an inner stub restraining housing comprised of clamping jaws 33 and 34, which are connected to the horizontal aligning platform 20 as described below in reference to the clamping apparatus 29. The inner stub restraining housing has a bottom 28 which is supportably connected to the horizontal guiding platform 20. Attached to the underside of the horizontal guiding platform is the clamping apparatus 29, best seen in FIG. 3. The clamping apparatus comprises a driving mechanism 31 attached via joint 32 to a bracket 30 attached to the platform. The piston of the driving mechanism is hingeably attached to a T-shaped lever 35 which is rotatably attached to bracket 30 at joint 28, to clamp jaw 33 at joint 37, and at joint 38 to angular lever 40. Angular lever 40 is additionally rotatably attached to bracket 30 at joint 39 and to clamp jaw 34 at joint 47. Through this lever mechanism, the expansion of the hydraulic cylinder driving mechanism 31 is effective to bring clamp jaws 33 and 34 together such that, when the inner stub is disposed therebetween, it is securely grasped. The bottom 28 provides vertical support for the inner stub.

The aligning frame 2 can be locked in its upper aligning position by a locking apparatus. In this embodiment of the invention, the locking apparatus consists of latches 42 which are hingeably attached to the guide stands 4 via joints 43, best seen in FIG. 2. These latches can be actuated by hydraulic cylinder driving mechanism 44 Platform 20 has brackets 45 which have locking bolts or locking bars 46. It is these bolts or bars which are engaged by latches 42 to secure the platform in its raised aligning position.

Pressure screws 47 serve to restrict the movement of the aligning plates 21.

The operation of the apparatus of the invention is described below. The anode rod 7, suspended from an overhead conveyor mechanism, is brought into the aligning apparatus via the conveyor guide 6. When the rod reaches the receiving position, the centering apparatus 13 is actuated by cylinder driving mechanism 14. This driving mechanism engages the two centering flaps (or collars) 16 so that they close about the rod. The closed centering apparatus, while centering and steadying the movement of the rod in the horizontal plane, allows the rod to be moved up or down.

Once the anode rod is steadied in the centering position, the horizontal guiding platform 20 is lifted through the action of the lifting cylinder 18. While the platform is being lifted, the inner stub 10 is inserted into stub restraining opening 27. Concurrently, stubs 9 and 11 are inserted into the receiving openings of ball-and-socket joints 25. The pivotability of these receiving means openings allows the stubs to be inserted even when they are misaligned (and thus not perpendicular to the horizontal aligning platform).

Once the stubs are fully engaged by the restraining and receiving openings, the restrained inner stub comes to rest against the bottom 28 of the opening 27. This bottom, which is attached to the horizontal guiding platform, then supports the anode rod while the platform is further lifted until the supported anode rod comes to rest against fittings 12 which comprise the anode rod supporting elements.

At this point, the aligning apparatus is locked into this aligning position by means of latches 42, which engage bolts 46. In this position, the yoke is restrained from lateral and upwards motion by fittings 12 and restraining elements 27, 33, 34 during the alignment process. The latching action is intended to assure that this restraint or support is fully and securely engaged against the yoke.

The inner stub engaged by the restraining opening is then tightly clamped (or was previously clamped) by clamping jaws 33 and 34, which are actuated by clamping apparatus 29.

The cylinders 22 are then engaged and they force the aligning plates 21, on which the outer stub receiving ball and socket joints are mounted, to move in opposite directions. The movement of each aligning plate continues until each has reached its respective end stop 47. At the end of this cycle, the outer stubs are bent back into their original alignment parallel to the anode rod.

The latches 42 and the clamping jaws 33 and 34 are then released, and the guiding platform is lowered. The rod and yoke, now supported by the external overhead conveyor, are lowered to release them from the anode rod support elements. Then, the means of securing the rod is released and the aligned rod is transported out of the apparatus. The apparatus is then ready to receive another anode rod.

Those of ordinary skill will recognize that the apparatus may include electrical detectors and that the aligning process may be controlled by programmed electronic control.

| List of Reference Symbols Used in the Drawings | |
|---|---|
| overall frame | 1 |

-continued

| List of Reference Symbols Used in the Drawings | |
|---|---|
| aligning frame | 2 |
| common base plate | 3 |
| guide stands (2) | 4 |
| guide rails | 5 |
| conveyor guide | 6 |
| anode rod | 7 |
| transverse yoke | 8 |
| anode stubs | 9, 10, 11 |
| exchangeable fittings | 12 |
| rod centering apparatus | 13 |
| hydraulic cylinder driving mechanism | 14 |
| piston rod | 15 |
| centering flaps | 16 |
| vertical guide | 17 |
| hydraulic lifting cylinders | 18 |
| joints | 19 |
| horizontal guiding platform | 20 |
| aligning plates | 21 |
| hydraulic aligning cylinders (2) | 22 |
| joints | 23, 24 |
| ball-and-socket joint parts with ring-shaped openings | 25 |
| spherical circumferential surface (fit with bearings or bearing openings) | 26 |
| opening for inner stub restrainer | 27 |
| stub restrainer bottom | 28 |
| bracket | 30 |
| hydraulic cylinder driving mechanism | 31 |
| joint | 32 |
| clamping jaws | 33, 34 |
| T-shaped 3-arm lever | 35 |
| joints | 36, 37, 38, 39 |
| angular lever | 40 |
| joint | 41 |
| latch | 42 |
| joint | 43 |
| hydraulic cylinder driving mechanism | 44 |
| brackets | 45 |
| locking bolts or locking bars | 46 |
| pressure screws | 47 |

What is claimed is:

1. An apparatus for aligning the stubs disposed on the yoke of an anode rod used in an aluminum electrolytic extraction cell, the anode rod having a yoke portion to which are secured two outer and an inner stub and a rod portion, said apparatus comprising a platform, first and second receiving means, slideably mounted on said platform, for grasping the two outer stubs, and means attached to said platform for driving said first receiver means in a direction directly opposite the movement of said second receiver means.

2. The anode stub aligning apparatus of claim 1 further comprising means for restraining at least one stub interposed between said two outer stubs from movement along an axis perpendicular to the major axis of said one stub.

3. An apparatus for aligning the stubs disposed on the yoke of an anode rod used in an aluminum electrolytic extraction cell, the anode rod having a yoke portion to which are secured two outer and an inner stub and a rod portion, said apparatus comprising a frame into which an anode rod is introduced so that the rod portion of the anode rod extends outside the frame and yoke portion is within the frame, a guide platform within said frame and adjustably mounted for movement towards and away from an introduced anode rod, a pair of aligning plates supported for motion by said platform, a pair of outer stub receiving means each mounted by one of said aligning plates and having openings therein for receiving the outer stubs of an introduced anode rod, and means for forcing said aligning plates to move in opposite directions to effectuate proper alignment of the outer stubs.

4. The apparatus for aligning anode stubs of claim 3, wherein said aligning plate forcing means comprise a hydraulic cylinder disposed between said aligning plates, said cylinder driveably connected to each of said plates.

5. The apparatus for aligning anode stubs of claim 3, comprising means secured to said platform for restraining said inner stub from movement along an axis perpendicular to the major axis of said inner stub.

6. The apparatus for aligning anode stubs of claim 5, wherein said restraining means comprise clamping means which prevent motion in any direction by a clamped stub.

7. The apparatus for aligning anode stubs of claim 5, comprising means attached to said frame for supporting the anode yoke against movement towards the portion of the rod exterior to the frame and against movement lateral to the major axis of said inner stub.

8. The apparatus for aligning anode stubs of claim 7, wherein said supporting means comprise replaceable fittings.

9. The apparatus for aligning anode stubs of claim 7, comprising means for driving said platform towards an introduced anode rod.

10. The apparatus for aligning anode stubs of claim 9, wherein said means of restraining an inner stub has a bottom against which said inner stub and the attached anode rod can be supported and wherein said means of driving said platform is effective to drive the supported anode rod.

11. The apparatus for aligning anode stubs of claim 9, comprising locking means secured to said frame and lock recieving means attached to said platform, said locking means being able to engage said lock receiving means when said platform is in an elevated position.

12. The apparatus for aligning anode stubs of claim 11, comprising a cylinder driving means attached to said frame for actuating said locking means, wherein said locking means comprise latches.

13. The apparatus for aligning anode stubs of claim 9, wherein said driving means comprise a lifting cylinder.

14. The apparatus for aligning anode stubs of claim 5, wherein said outer stub receiving means comprise ball-and-socket joints pivotally mounted on said plates and having openings therein which extend through said joints for receiving the outer stubs of an introduced anode rod.

15. The apparatus for aligning anode stubs of claim 14, wherein axis along which an intoduced anode rod is oriented is the vertical axis and the portion of the anode rod which would be outside the overall frame is disposed above the overall frame.

16. The apparatus for aligning anode stubs of claim 15, comprising two guide rails attached to an upper portion of said frame, wherein a portion of each of said guide rails is parallel to the corresponding portion of the other guide rail, said parallel portions being disposed on either side of an introduced anode rod.

17. The apparatus for aligning anode stubs of claim 14, comprising end stop means attached to said platform for limiting the motion of said aligning plates under the impetus of said aligning plate forcing means.

18. The apparatus for aligning anode stubs of claim 17, wherein said end stops comprise pressure screws.

19. The apparatus for aligning anode stubs of claim 14, wherein said guide platform is box-shaped and said aligning plate is supported within said box-shaped frame.

20. The apparatus for aligning anode stubs of claim 14, wherein said aligning plate forcing means comprise two hydraulic cylinders disposed between said aligning plates, each of said cylinders driveably connected to each of said plates.

21. The apparatus for aligning anode stubs of claim 14, wherein said restraining means comprise clamping means which prevent motion in any direction by a clamped stub.

22. The apparatus for aligning anode stubs of claim 21, wherein said clamping means comprise clamping jaws, lever means to which said jaws are driveably connected, and a clamp driving cylinder driveably connected to said lever means, the driving action of said clamp driving cylinder is conveyed to said clamps via said lever means and effectuates the closing of said clamps.

* * * * *